US006789269B1

(12) United States Patent
Scovin

(10) Patent No.: US 6,789,269 B1
(45) Date of Patent: Sep. 14, 2004

(54) PANTS WITH ONE OR MORE ZIPPERS ON THE REAR THEREOF

(76) Inventor: Scott Scovin, 4 Blueberry La., Oxford, CT (US) 06478

( * ) Notice: Subject to any disclaimer, the term of this patent is extended or adjusted under 35 U.S.C. 154(b) by 0 days.

(21) Appl. No.: 10/762,694

(22) Filed: Jan. 22, 2004

Related U.S. Application Data

(60) Provisional application No. 60/441,705, filed on Jan. 23, 2003.

(51) Int. Cl.[7] ..... A41D 1/06
(52) U.S. Cl. ..... 2/227; 2/69
(58) Field of Search ..... 2/69, 456, 79, 2/78.2, 227, 114, 408, 228, 238, 69.5, 83, 85, 93, DIG. 1

(56) References Cited

U.S. PATENT DOCUMENTS

| | | | | | |
|---|---|---|---|---|---|
| 1,783,538 | A | * | 12/1930 | Herskowitz | 2/79 |
| 1,799,336 | A | * | 4/1931 | Walser | 2/71 |
| 4,447,911 | A | * | 5/1984 | Marcellaro | 2/79 |
| 5,010,595 | A | * | 4/1991 | Stradley | 2/227 |
| 6,477,711 | B1 | * | 11/2002 | Freeman et al. | 2/69 |

* cited by examiner

*Primary Examiner*—Tejash Patel
(74) *Attorney, Agent, or Firm*—John H. Rozier

(57) ABSTRACT

In a preferred embodiment, a pair of pants, including: a seat portion, a waist portion, and two leg portions joined together in a conventional manner to form the pants; and at least one zipper disposed on a rear of the pants between a crotch area and a top of the pants, the at least one zipper being partially or completely unzippable to reveal a selected portion of a wearer of the pants.

10 Claims, 2 Drawing Sheets

PANTS WITH ONE OR MORE ZIPPERS ON THE REAR THEREOF

CROSS-REFERENCE TO RELATED APPLICATION

The present application claims the benefit of the filing date of U.S. Provisional Application Ser. No. 60/441,705, filed Jan. 23, 2003, and titled PANTS WITH ONE OR MORE ZIPPERS ON THE REAR THEREOF.

BACKGROUND OF THE INVENTION

1. Field of the Invention

The present invention relates to pants generally and, more particularly, but not by way of limitation, to a novel pair of pants with one or more zippers disposed on the rear thereof.

2. Background Art

It is currently the fashion to expose areas of skin that were not formerly exposed. For example, plunging necklines and bare midriffs have become popular, particularly among younger women. However, except for wearing pants lower and lower, nothing is known that permits an area of the rear of the wearer of pants to be exposed below the normal waist of the pants.

Accordingly, it is a principal object of the present invention to provide a means of permitting the wearer of pants to expose a portion of the wearer of pants below the top of the pants.

It is an additional object of the invention to provide such a means that can selectively expose such an area of the wearer.

It is a further object of the invention to provide such a means that is economical to manufacture.

Other objects of the present invention, as well as particular features, elements, and advantages thereof, will be elucidated in, or be apparent from, the following description and the accompanying drawing figure.

SUMMARY OF THE INVENTION

The present invention achieves the above objects, among others, by providing, in a preferred embodiment, a pair of pants, comprising: a seat portion, a waist portion, and two leg portions joined together in a conventional manner to form said pants; and at least one zipper disposed on a rear of said pants between a crotch area and a top of said pants, said at least one zipper being partially or completely unzippable to reveal a selected portion of a wearer of said pants.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
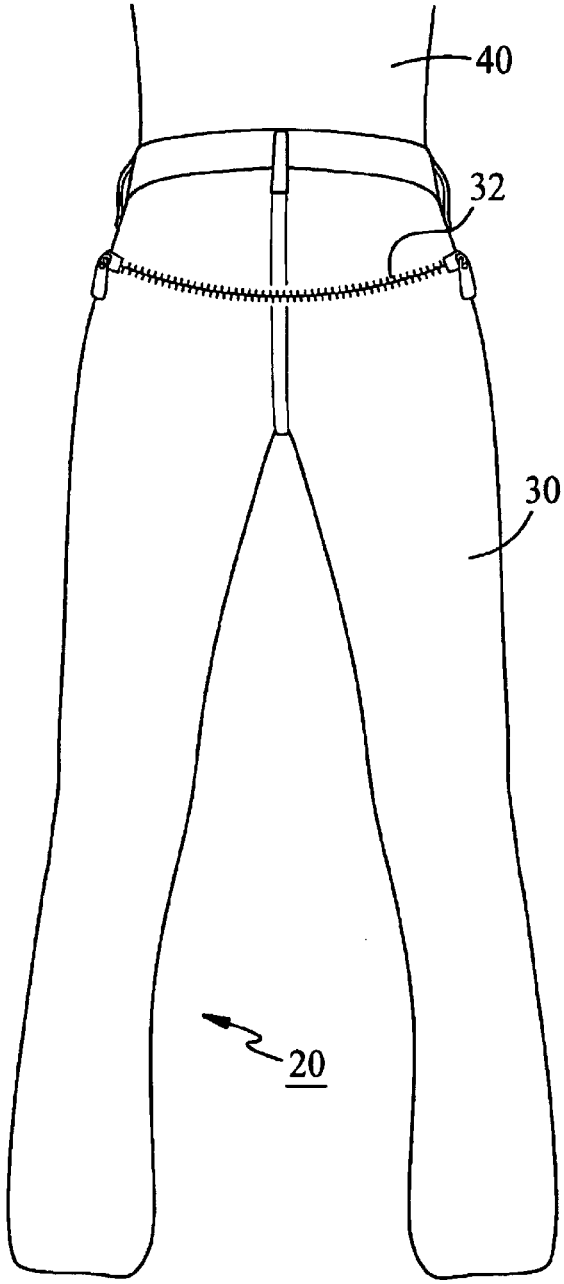
FIG. 1 is a rear elevational view of one embodiment of the present invention.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

Figure 2:
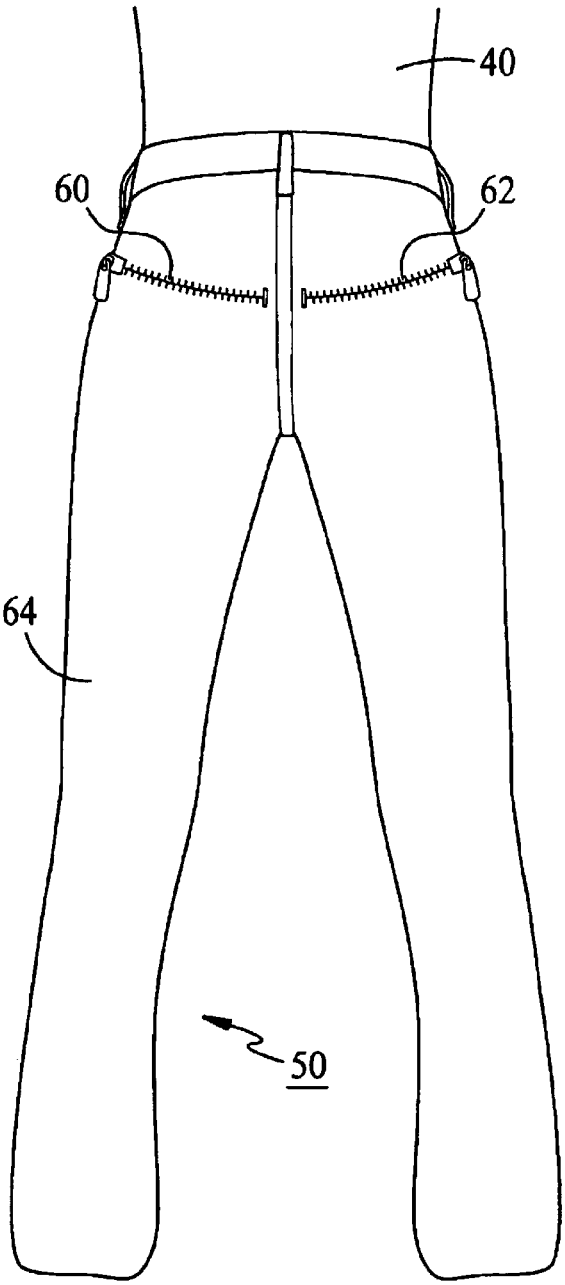
FIG. 2 is a rear elevational view of another embodiment of the present invention.

FIG. 1 illustrates one embodiment of the present invention, generally indicated by the reference numeral 20. Embodiment 20 includes an otherwise conventional pair of pants 30 to which has been added a generally horizontal zipper 32 disposed between the crotch and the top of the pants. Zipper 32 extends to the sides of pants 30 at the start of the hips of a wearer 40. Zipper 32 can be selectively unzipped from either side going toward the opposite side to reveal as little or as much as the wearer desires. It will be understood that, in this embodiment as well as the embodiments shown on the other drawing figures, the rear pockets of the pants are preferably omitted. FIG. 2 illustrates another embodiment of the present invention, generally indicated by the reference numeral 50. In this case, zipper 32 (FIG. 1) has been replaced by two zippers 60 and 62 extending from the sides of a pair of otherwise conventional pants 64 toward a center portion of the pants to permit one or both sides to be uncovered a selected degree by unzipping either or both zippers from the side toward the center.

Figure 3:
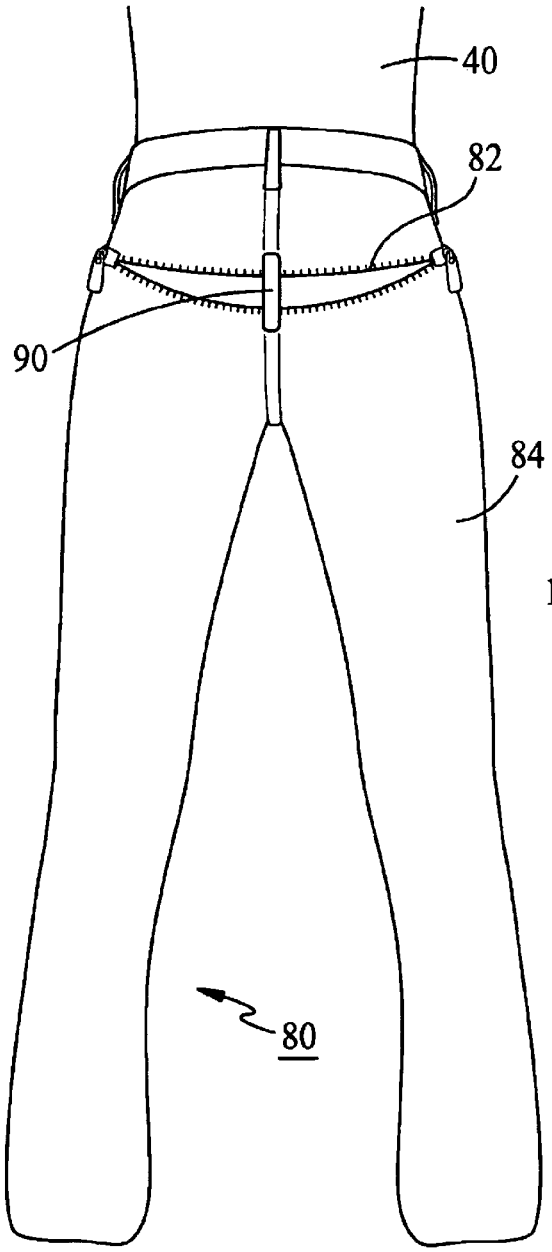
FIG. 3 is a rear elevational view of a further embodiment of the present invention.

FIG. 3 illustrates a further embodiment of the present invention, generally indicated by the reference numeral 80. In this case, a single zipper 82 extends from the sides of a pair of otherwise conventional pants 84. As was the case with zipper 32 (FIG. 1), zipper 82 can be unzipped from either side of pants 84 to reveal as little or as much as the wearer desires. To ensure that the halves of zipper 82 do not provide too great a gap when the zipper is fully, or partially unzipped, a vertical loop of material 90 is provided generally centrally of the zipper to hold the two halves of the zipper open only a desired distance.

Figure 4:
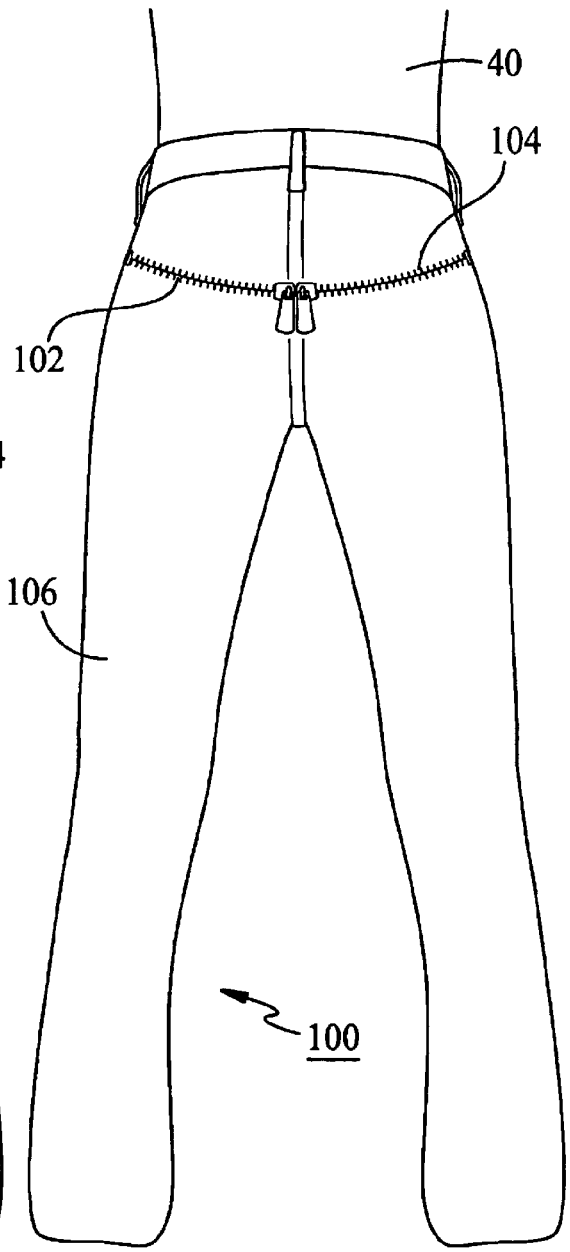
FIG. 4 is a rear elevational view of an additional embodiment of the present invention.

FIG. 4 illustrates an additional embodiment of the present invention, generally indicated by the reference numeral 100. In this case, zipper 32 (FIG. 1) has been replaced by two zippers 102 and 104 extending from the sides of a pair of otherwise conventional pants 106 toward and meeting near a center portion of the pants to permit one or both sides to be uncovered a selected degree by unzipping either or both zippers from the center toward the sides.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention that, as a matter of language, might be said to fall therebetween.

The embodiments of the invention in which an exclusive property or privilege is claimed are defined as follows:

1. A pair of pants, comprising:

(a) a seat portion, a waist portion, and two leg portions joined together in a conventional manner to form said pants;

(b) at least one zipper disposed on a rear of said pants between a crotch area and a top of said pants, said at least one zipper being partially or completely unzippable to reveal a selected portion of a wearer of said pants; and (c) said at least one zipper lying on a generally horizontal line.

2. A pair of pants, as defined in claim 1, wherein: said at least one zipper comprises two zippers.

3. A pair of pants, as defined in claim 2, wherein: said two zippers are unzippable from distal ends of said two zippers.

4. A pair of pants, as defined in claim 3, wherein: proximal ends of said two zippers meet near a central seam of said pants.

5. A pair of pants, as defined in claim 2, wherein: said two zippers are unzippable from proximal ends of said two zippers.

6. A pair of pants, as defined in claim 5, wherein: said proximal ends of said two zippers meet near a central seam of said pants.

7. A pair of pants, as defined in claim 1, wherein: said at least one zipper is unzippable from either distal end or both distal ends of said at least one zipper.

8. A pair of pants, as defined in claim 1, wherein: said at least one zipper is unzippable from a center of said at least one zipper.

9. A pair of pants, as defined in claim 1, further comprising: a loop joining upper and lower halves of said at least one zipper such that said halves are held together a selected distance when said at least one zipper is partially or completely unzipped.

10. A pair of pants, comprising:

(a) a seat portion, a waist portion, and two leg portions joined together in a conventional manner to form said pants;

(b) at least one zipper disposed on a rear of said pants between a crotch area and a top of said pants, said at least one zipper being partially or completely unzippable to reveal a selected portion of a wearer of said pants; and (c) a loop joining upper and lower halves of said at least one zipper such that said halves are held together a selected distance when said at least one zipper is partially or completely unzipped.

* * * * *

UNITED STATES PATENT AND TRADEMARK OFFICE

CERTIFICATE OF CORRECTION

PATENT NO. : 6,789,269 B1
DATED : September 14, 2004
INVENTOR(S) : Scott Scovin

It is certified that error appears in the above-identified patent and that said Letters Patent is hereby corrected as shown below:

Title page,
Item [74], *Attorney, Agent, or Firm*, should read -- John H. Crozier --

Signed and Sealed this

Thirtieth Day of November, 2004

JON W. DUDAS
*Director of the United States Patent and Trademark Office*